US009013355B1

(12) United States Patent
Yang et al.

(10) Patent No.: US 9,013,355 B1
(45) Date of Patent: Apr. 21, 2015

(54) L-SHAPED FEED FOR A MATCHING NETWORK FOR A MICROSTRIP ANTENNA

(71) Applicant: Airgain, Incorporated, San Diego, CA (US)

(72) Inventors: Simon Yang, Carlsbad, CA (US); Keyoor Gosalia, Carlsbad, CA (US)

(73) Assignee: Airgain, Inc., San Diego, CA (US)

( * ) Notice: Subject to any disclaimer, the term of this patent is extended or adjusted under 35 U.S.C. 154(b) by 0 days.

(21) Appl. No.: 14/505,591

(22) Filed: Oct. 3, 2014

Related U.S. Application Data

(62) Division of application No. 13/455,085, filed on Apr. 24, 2012, now Pat. No. 8,854,265.

(60) Provisional application No. 61/480,182, filed on Apr. 28, 2011.

(51) Int. Cl.
*H01Q 1/38* (2006.01)
*H01Q 9/04* (2006.01)

(52) U.S. Cl.
CPC ..... *H01Q 9/045* (2013.01)

(58) Field of Classification Search
USPC ..... 343/700 MS, 846, 850, 702, 862
See application file for complete search history.

(56) References Cited

U.S. PATENT DOCUMENTS

| | | | | |
|---|---|---|---|---|
| 7,994,985 | B2 * | 8/2011 | Luk et al. | 343/700 MS |
| 2009/0146883 | A1 * | 6/2009 | Chin et al. | 343/700 MS |
| 2010/0194643 | A1 * | 8/2010 | Petros | 343/700 MS |
| 2012/0146869 | A1 * | 6/2012 | Holland et al. | 343/795 |

* cited by examiner

*Primary Examiner* — Huedung Mancuso
(74) *Attorney, Agent, or Firm* — Clause Eight IPS; Michael Catania

(57) ABSTRACT

A microstrip patch antenna including a ground plane base, an L-shaped feed structure and a laminate structure is disclosed herein. A matching network is formed by a clearance member of the laminate structure around a pin and a stub of the L-shaped feed structure on the bottom surface in which the clearance member around the pin effectively decreases shunt inductance and reduces a series capacitance at a feed point to enable a 50 ohm wideband operation.

9 Claims, 9 Drawing Sheets

L-SHAPED FEED FOR A MATCHING NETWORK FOR A MICROSTRIP ANTENNA

CROSS REFERENCE TO RELATED APPLICATION

The present application is a divisional application of U.S. patent application Ser. No. 13/455,085, filed on Apr. 24, 2012, which claims priority to U.S. Provisional Patent Application No. 61/480,182, filed on Apr. 28, 2011, both of which are hereby incorporated by reference in their entireties.

STATEMENT REGARDING FEDERALLY SPONSORED RESEARCH OR DEVELOPMENT

Not Applicable

BACKGROUND OF THE INVENTION

1. Field of the Invention

The present invention generally relates to microstrip patch antennas. More specifically, the present invention relates to microstrip patch antennas having an L-shaped feed.

2. Description of the Related Art

Proximity coupled feed mechanism for microstrip patch antennas (and specifically an L-shaped feed) are known in the prior art. An example of one is Luk et al., U.S. Pat. No. 7,994,985 for an Isolation Enhancement Technique For Dual-Polarized Probe-Fed Patch Antenna, which discloses two L-shaped feed probes in a patch antenna.

BRIEF SUMMARY OF THE INVENTION

The present invention is an antenna system with a specific feed mechanism. In the preferred embodiment, the antenna is a microstrip patch antenna with a proximity L-shaped feed and a two layers laminate structure. In the preferred embodiment, the size of the antenna corresponds to operation in the frequency range of 1.7 GHz to 2.2 GHz. The same operating principles may be utilized to design an embodiment that operates at other frequency bands.

The specific feed mechanism leads to favorable performance parameters in two separate ways in the preferred embodiment. First, the performance of the antenna is wideband due to the specific feed mechanism. In the preferred embodiment, the feed comprises a matching network incorporated in the L-shaped structure attached to a bottom layer of a laminate structure, and the clearance around a center pin on the top layer of the laminate structure. In other embodiments, a similar feed mechanism can be implemented for various combinations of frequencies (or a different frequency band). Second, the L-shaped feed mechanism excites the currents on the top layer via proximity coupling (no direct connection) and leads to very stable and directional current distribution on the top layer. The very stable and directional current distribution on the top layer helps in improving the radiated electromagnetic field distribution around the antenna with very little radiation towards the back of the antenna. Most of the radiated energy is focused broadside (in front) to the antenna. This improves a front-to-back ratio of the radiation from the antenna structure for a given size of a ground plane base as depicted in the preferred embodiment.

One aspect of the present invention is a microstrip patch antenna. The microstrip patch antenna preferably includes a ground plane base, a L-feed structure and a laminate structure. The L-feed structure preferably includes a pin extending from the ground plane base and a stub substantially perpendicular to the pin. The laminate structure is attached to the stub of the L-feed structure. The laminate structure preferably includes a substrate layer, a metal layer and a clearance gap. The substrate layer has a bottom surface and a top surface. The metal layer is disposed on a portion of the top surface of the substrate layer. The stub is attached to the bottom surface of the substrate layer. The clearance gap is located around the pin of the L-shaped feed structure in proximity of the metal layer of the laminate structure at the top of the surface. A matching network is formed by the clearance member around the pin and the stub on the bottom surface in which the clearance member around the pin effectively decreases shunt inductance and reduces a series capacitance at a feed point and the stub member reduces the shunt inductance close to the feed point to enable a 50 ohm wideband operation.

Another aspect of the present invention is a patch antenna wherein a matching network is formed by the clearance member around the pin and the stub on the bottom surface in which the clearance member around the pin effectively decreases shunt inductance and reduces a series capacitance at a feed point to enable a predetermined wideband operation. The patch antenna includes a ground plane base, an L-feed structure and a laminate structure. The L-feed structure preferably includes a pin extending from the ground plane base and a stub substantially perpendicular to the pin. The laminate structure is attached to the stub of the L-feed structure. The laminate structure includes a substrate layer, a metal layer and a clearance gap. The substrate layer has a bottom surface and a top surface. The metal layer is disposed on a portion of the top surface of the substrate layer. The stub is attached to the bottom surface of the substrate layer. The clearance gap is located around the pin of the L-shaped feed structure in proximity of the metal layer of the laminate structure at the top of the surface.

Yet another aspect of the present invention is a patch antenna including a ground plane base, an L-shaped feed structure and a laminate structure. The laminate structure has a first end and a second end opposing the first end, and a stub of the L-shaped feed structure extends from a pin of the L-shaped feed structure towards the first end of the laminate structure, and a metal layer of the laminate structure extends from the second end of the laminate structure towards the pin.

The metal utilized with microstrip patch antenna any of the embodiments is preferably copper. Alternatively, the metal is one of brass, aluminum, silicon steel, gold or silver.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
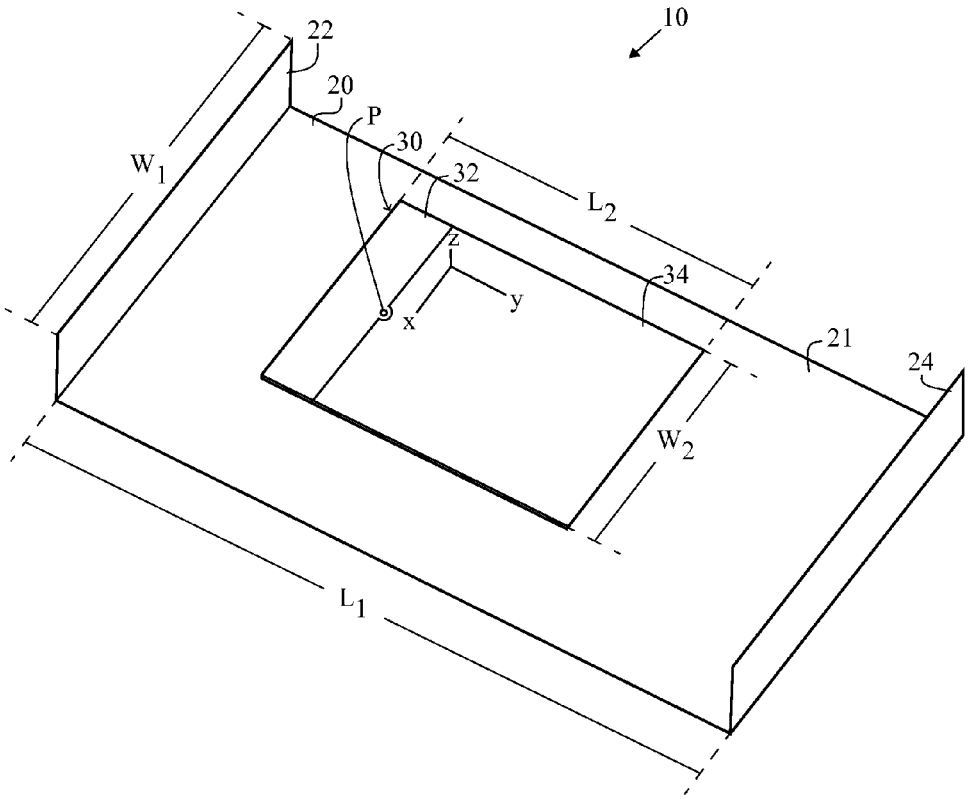
FIG. 1 is a top perspective view of a preferred embodiment of a microstrip patch antenna.

As shown FIGS. 1-4, a microstrip patch antenna is generally designated 10. The microstrip patch antenna 10 preferably comprises a ground plane base 20, a laminate structure 30 and an L-shaped feed structure 40. The microstrip patch antenna 10 is designed to preferably both transmit and receive in the frequency range of 1.7-2.2 GHz with a VSWR of 2:1.

The ground plane base 20 preferably comprises a main body 21, a first sidewall 22 and a second sidewall 24. The first sidewall 22 preferably extends upward from the main body 21 of the ground plane base 20, and the first sidewall 22 preferably perpendicular to the main body 21. The second sidewall 24 is preferably positioned at an opposing end of the main body 21 from the first sidewall 22. The second sidewall 24 also preferably extends upward from the main body 21 of the ground plane base 20, and the second sidewall 24 is preferably perpendicular to the main body 21. Although there is no technical limit to the thickness of the ground plane base 20 and the sidewalls 22 and 24, a preferred thickness is 0.25 millimeters ("mm") to 2.0 mm. The preferred width, W1, of the ground plane base 20 for the preferred embodiment is 76 mm, and the preferred length, L1, of the ground plane base 20 for the preferred embodiment is 136 mm. The ground plane base 20 is preferably bent at 90 degrees at its edges to create the first and second sidewalls 22 and 24. The first and second sidewalls 22 and 24 are preferably 20 mm in length from the main body 21. The first and second sidewalls 22 and 24 can be adjusted in length to suit the frequency of operation.

Figure 2:
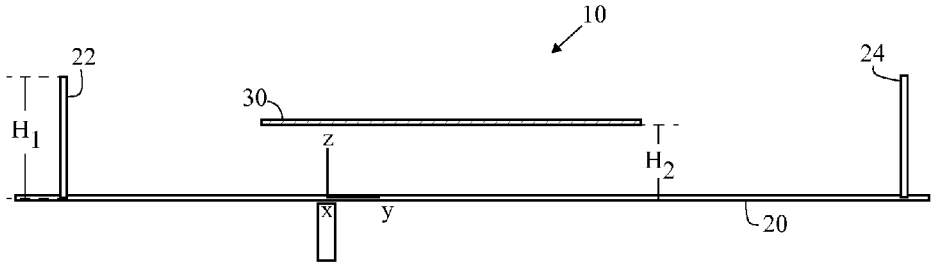
FIG. 2 is a side plan view of the microstrip patch antenna of FIG. 1.

The laminate structure 30 supports a top and bottom metallization of the radiating structure. The laminate structure 30 preferably comprises a substrate layer 32 and a top layer 34. The top layer 34 is the patch antenna metallization. The top layer 34 is preferably a metalized layer, and the substrate layer 32 is preferably a dielectric substrate such as PTFE composites or alumina. The laminate structure 30 also preferably comprises a clearance pin member 36. The top layer 34 is disposed on a portion of a top surface of the substrate layer 32, and preferably does not cover the entire top surface of the substrate layer 32. The laminate structure 30 preferably has a thickness ranging from 0.5 mm to 1.0 mm. In a most preferred embodiment, the width W2 of the laminate structure 30 is approximately 45 mm in and a length L2 of the laminate structure 30 is 61.5 mm. The dimensions (length and width) of the top layer 34 vary to accommodate different frequency operations for other embodiments. The laminate structure 30 is preferably suspended approximately 12 mm over the ground plane base 20 at the bottom surface of the laminate structure 30, as shown in FIG. 2.

The L-feed structure 40 preferably comprises a pin member 42 and a stub member 44. The stub member 44 is preferably perpendicular to the pin member 42. The stub member 44 is attached to a bottom surface of the substrate layer 32 of the laminate structure 30. The stub member 44 preferably has a length of approximately 10.5 mm and a width of approximately 2 mm. The pin member 42 preferably extends upward from an aperture 26 in the ground plane base 20, and the pin member 42 is preferably perpendicular to the ground plane base 20.

Figure 3:
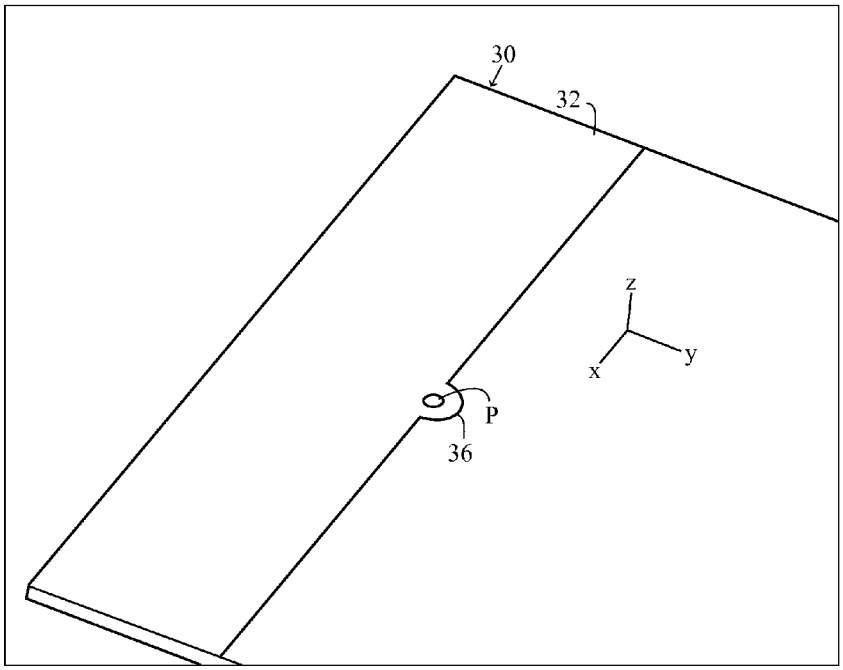
FIG. 3 is an isolated view of a laminate of the microstrip patch antenna of FIG. 1.
Figure 4:
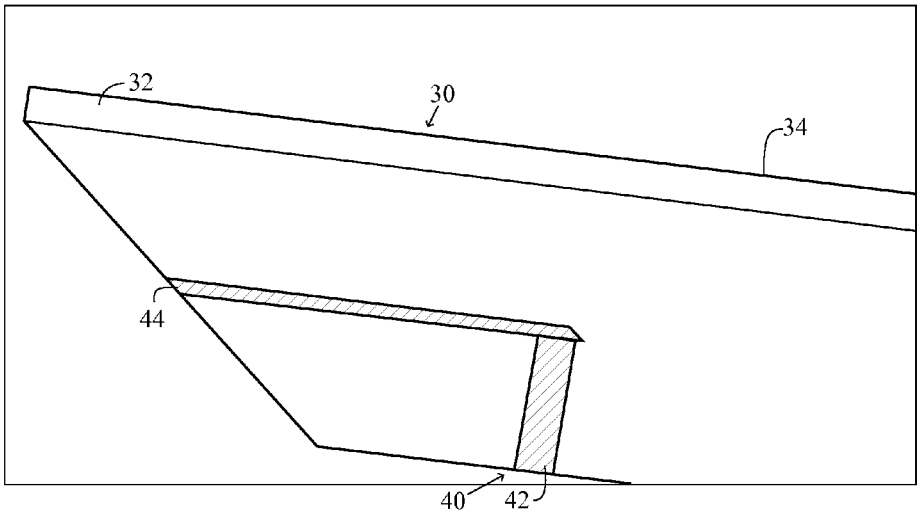
FIG. 4 is an isolated view of a bottom surface of a laminate of the microstrip patch antenna of FIG. 1.

A feed mechanism is depicted in detail in FIGS. 3-4. P is the center conductor of a coax feed which reaches the top layer 34 as shown in FIG. 3. The clearance member 36 provides a clearance around the center pin P in an amount which is preferably 0.5 mm in the preferred embodiment. The clearance can be adjusted in each embodiment to facilitate a proper impedance match to preferably 50 ohms. Moreover, the position P of the center pin can also be moved either within the laminate structure 30 or away from the edge of metallization of the top layer 34 for impedance matching purposes. FIG. 4 illustrates the bottom surface of a preferred embodiment of the laminate structure 30 which the stub 44 of the L-feed structure 40. The length of stub 44 is preferably 11 mm and the width is preferably 2 mm. Those skilled in the pertinent art will recognize that the length and width of the stub 44 can be adjusted for a proper and/or improved impedance match.

As described, the center pin P of the coax does not have to make contact with the top layer 34 of the laminate structure 30 to excite the top layer. The energy transfer takes place via coupling, and the clearance member 36 and the stub 44 add the necessary series and shunt reactances to achieve a wide band impedance match to 50 Ohms. For the depicted exemplary embodiment, the various parameters are tuned for operation within the 1.7-2.2 GHz frequency band.

As depicted in FIGS. 1-4, the preferred embodiment of the microstrip patch antenna 10 with an L-shaped feed structure 40 and the clearance around the center pin on the metalized top layer 34. The laminate structure 30 is preferably suspended by at least 12 mm over the ground plane base 20. The relatively high suspension and the low dielectric constant of the free space dielectric (between ground plane base 20 and the laminate structure 30) allow the performance of the microstrip patch antenna 10 to be broadband. However, the broadband behavior is not necessarily limited with respect to 50 ohms, required for efficient operation in a front end transceiver circuit. The feed mechanism allows the wideband performance to be shifted to 50 ohms (or any other real impedance value) without incurring excessive losses.

This is accomplished in the exemplary embodiment by a matching network formed by the clearance around the center pin and the L shaped feed stub on the bottom layer. The clearance around the center pin effectively decreases shunt inductance and reduces the series capacitance at the feed. The feed stub in this embodiment helps in reducing the shunt inductance close to the feed point. The combined action of both of these (with their various amounts of reactances) helps to shift the impedance locus from the high impedance area of the Smith chart to the center of the chart and hence enable 50 ohm wideband operation. The dimensions of the clearance and feed stub can be varied to control the location of the impedance locus on the Smith chart.

Figure 5:
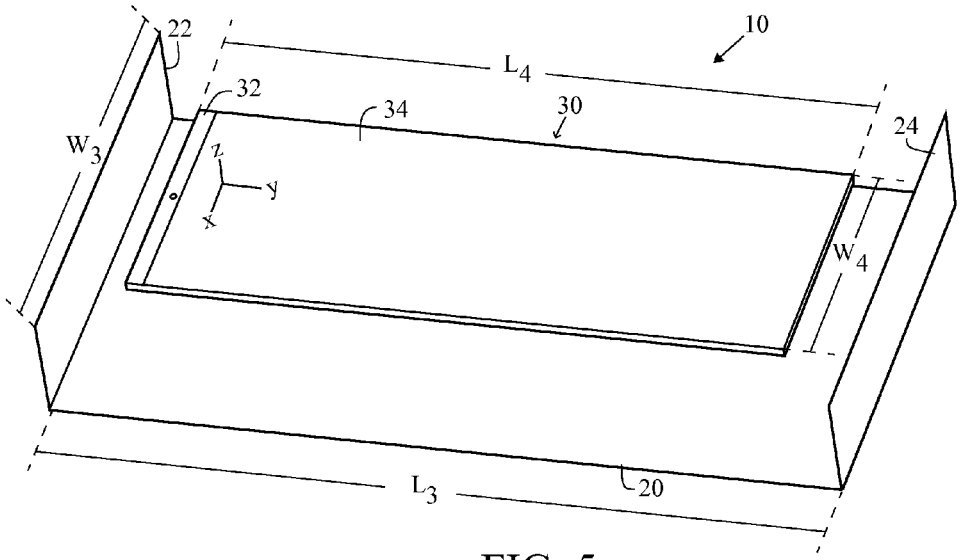
FIG. 5 is a top perspective view of an alternative embodiment of a microstrip patch antenna.
Figure 6:
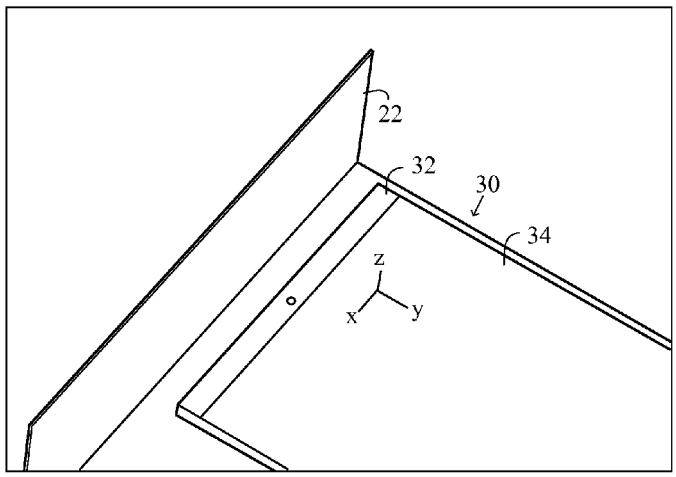
FIG. 6 is an isolated view of a laminate of the microstrip patch antenna of FIG. 5.
Figure 7:
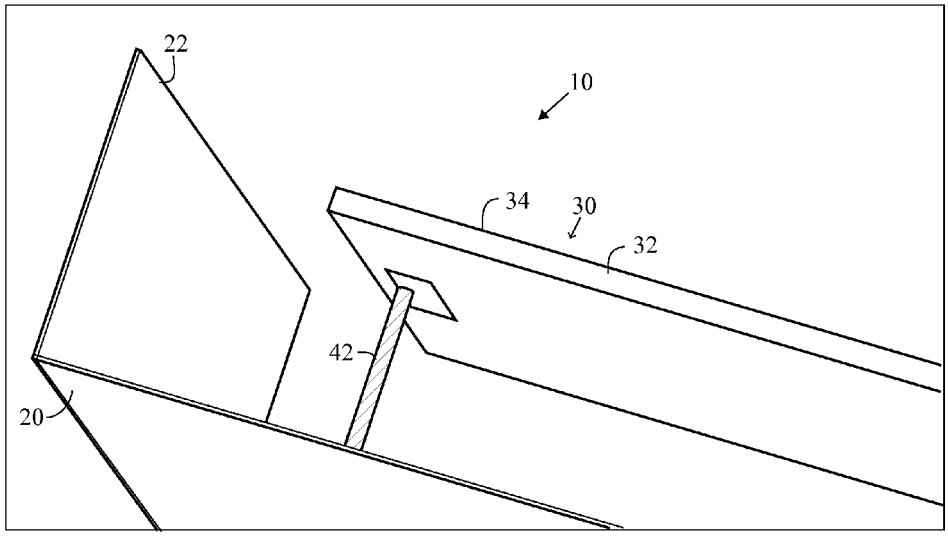
FIG. 7 is an isolated view of a bottom surface of a laminate of the microstrip patch antenna of FIG. 5.

FIGS. 5, 6 and 7 illustrate an alternative embodiment of a microstrip patch antenna 10 designed to work within the 825-895 MHz frequency band. In this alternative embodiment, the length, L4, of the laminate structure 30 is preferably 116 mm and the width, W4, is preferably 45 mm to accommodate the lower frequency operation. The preferred width, W3, of the ground plane base 20 for this alternative embodiment is 76 mm, and the preferred length, L3, of the ground plane base 20 for this alternative embodiment is 140 mm.

As shown in FIG. 6, there is no clearance required around the center pin P2 on the top layer (unlike the preferred embodiment illustrated in FIG. 1). The length and width of the stub member 44, required to perform impedance match to 50 ohms is 3 and 12 mm respectively. The stub member 44 dimensions can be altered to suit the required frequency of operation. In this alternative embodiment the stub member 44 adds the necessary reactance to the feed point for a proper impedance match to 50 ohms. The sidewalls 22 and 24 of the ground plane base 20 can be adjusted for frequency of operation-in this alternative embodiment the first and second sidewalls are each 20 mm in length.

The L-shaped feed structure 40 in the alternative embodiments illustrated in FIGS. 5-7, utilizes a different implementation of the L-shaped feed. In these embodiments, the clearance on the metalized top layer 34 is not required and the stub member 44 on the bottom surface of the laminate structure 30 is oriented towards the top layer 34. The stub member 44 allows the proper impedance match to 50 ohms by providing the right amount of reactance at the feed location.

The stub member 44 couples energy into the radiating structure and also acts as an impedance matching network. Due to this specific feed mechanism via proximity coupling, the surface current distribution on the metalized top layer 34 (the patch) is very directional and stable. Such a current distribution is necessary for a very symmetrical and directional radiation field from the antenna structure. Normally, to reduce back radiation, the size of the ground plane base 20 must be relatively large. However, where overall size is a constraint, different techniques as presented in this exemplary embodiment can be employed to reduce the back radiation. The pure (single directional) current distribution helps in improving the front to back ratio of the radiated far field energy.

The first and second sidewalls 22 and 24 of the ground plane base 20 also help to reduce the back radiation and help the front to back ratio. The length of the first and second sidewalls 22 and 24 can be varied to improve the back radiation depending on the frequency of operation.

Figure 8:
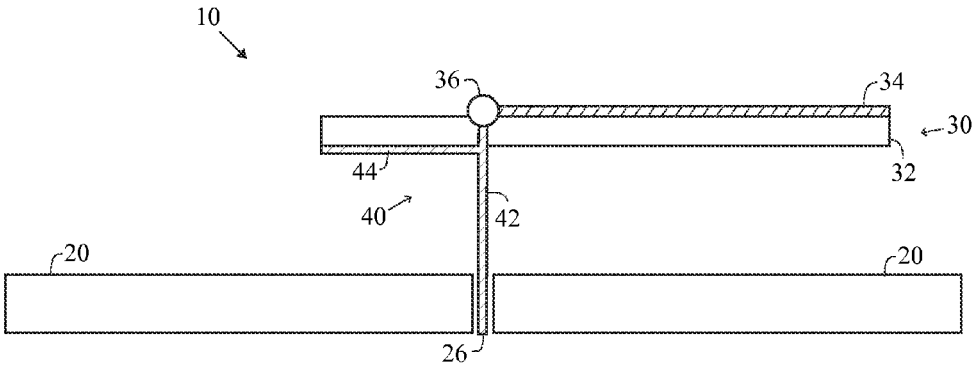
FIG. 8 is a side view of another alternative embodiment of a microstrip patch antenna.

FIGS. 8-12 illustrate various embodiments of the invention which may be adopted as required for specific frequency operation and dimensional limitations. FIG. 8 illustrates an alternative embodiment example wherein the feed mechanism comprises the stub member 44 of the L-shaped feed structure 40 on the bottom surface of the laminate structure 30 and the clearance around the center pin where it contacts the metalized top layer 34.

Figure 9:
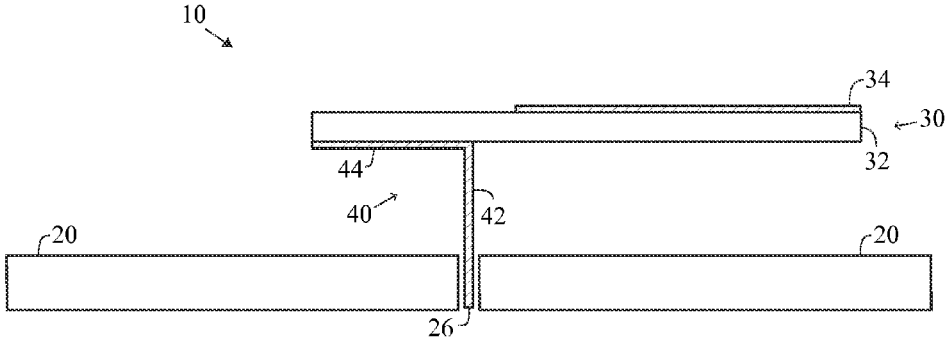
FIG. 9 is a side view of another alternative embodiment of a microstrip patch antenna.

In yet another alternative embodiment illustrated in FIG. 9, the clearance is removed and the stub member 40 of the L-shaped feed structure 40 is included on the bottom surface of the laminate structure 30 to present a different reactance to the feed for an impedance match. This embodiment can be applied based on the specific requirements. The metalized top layer 24 may also be separated from the center pin of the coax for lower coupling and impedance matching.

Figure 10:
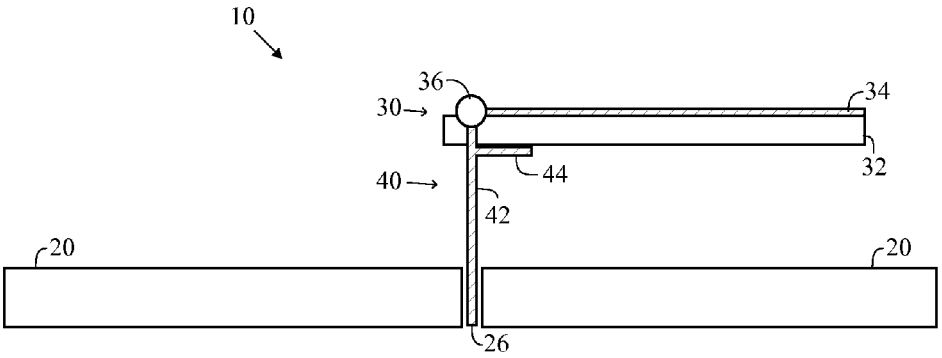
FIG. 10 is a side view of another alternative embodiment of a microstrip patch antenna.

FIG. 10 illustrates a further alternative embodiment of the antenna feed mechanism wherein the stub member 40 of the L-shaped feed structure 40 attached on the bottom surface of the laminate structure 30 is now oriented towards the top layer 34. This alternative embodiment arrangement introduces additional reactance at the feed and may be used for impedance matching. The arrangement with the clearance at the top layer 34 and the stub member 44 now increases the shunt capacitance while also reducing the series capacitance and shunt inductance. The dimensions of the stub member 44 are adjusted to match the impedance to 50 ohms while retaining the broadband impedance behavior.

Figure 11:
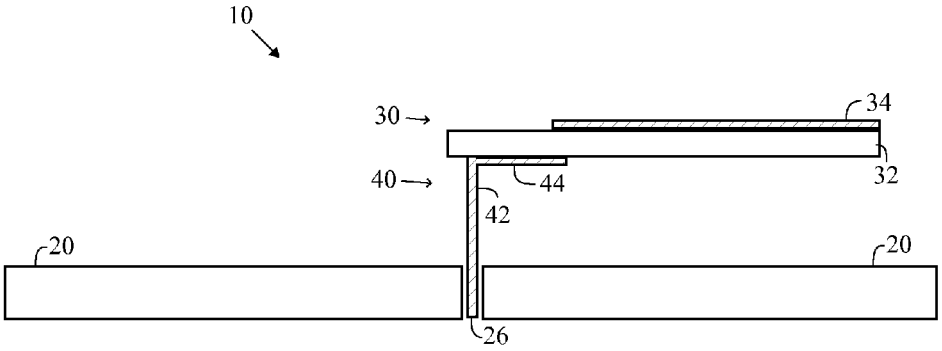
FIG. 11 is a side view of another alternative embodiment of a microstrip patch antenna.

FIG. 11 illustrates an alternative embodiment where the clearance at the top layer 34 and its reactance are not necessary. In this alternative embodiment, the stub member 40 of the L-shaped feed structure 40 attached on the bottom surface of the laminate structure 30 provides the necessary reactance adjustment to perform the impedance match.

In all of the alternative embodiments illustrated in FIGS. 8-11, the surface current distribution can be maintained pure and unidirectional, which helps in maintaining a high front to back ratio in the radiated far field.

Figure 12:
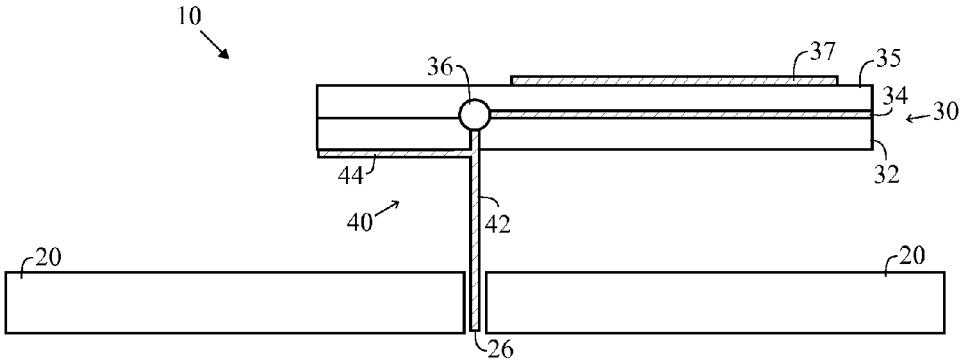
FIG. 12 is a side view of another alternative embodiment of a microstrip patch antenna.
Figure 13:
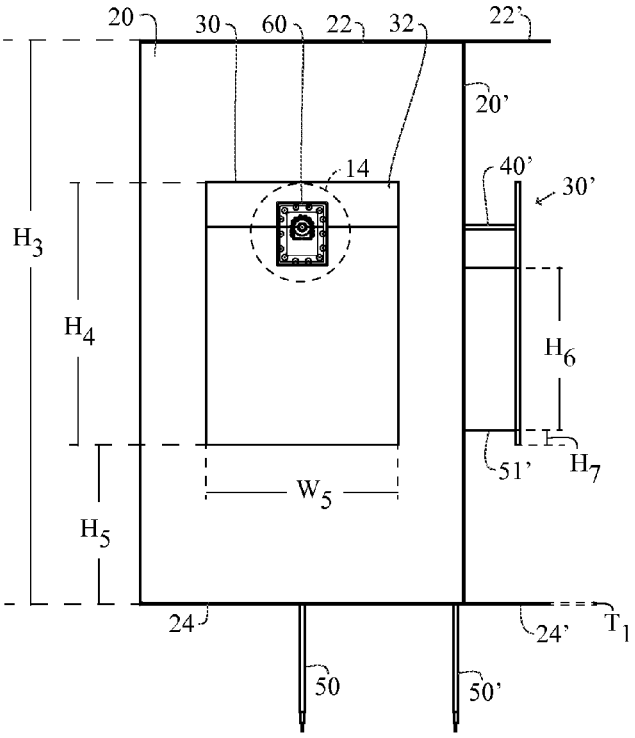
FIG. 13 is a top plan view of a microstrip patch antenna.

FIG. 12 illustrates a further alternative embodiment of a microstrip patch antenna which retains the broadband performance and introduces dual frequency operation due to the presence of a second patch in the form of a second substrate layer 35 and a second metal top layer 37 as part of the laminate structure 30. The dimensions and position of the second patch are adjusted to widen the impedance match and frequency performance of the antenna.

Figure 14:
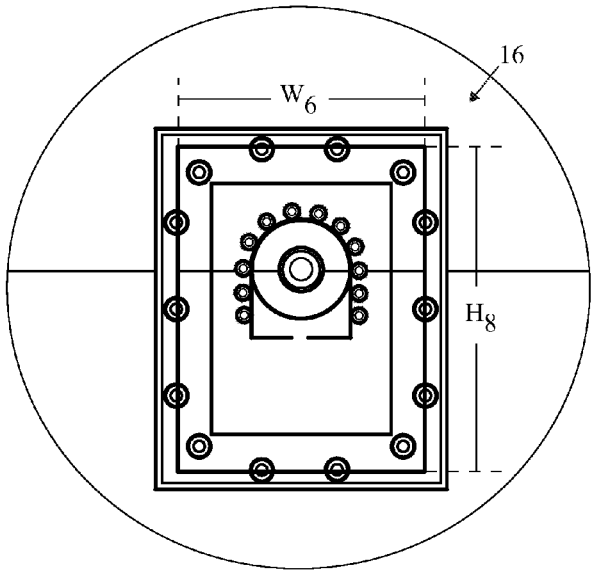
FIG. 14 is an enlarged isolated view of circle 14 of FIG. 13.
Figure 15:
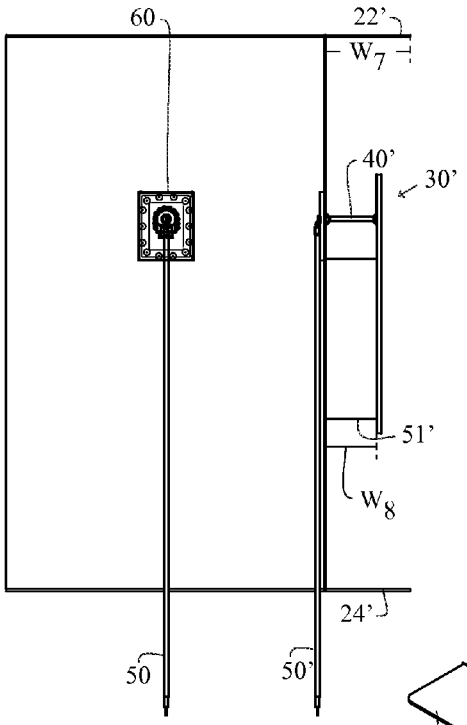
FIG. 15 is a top plan view of a microstrip patch antenna
Figure 16:
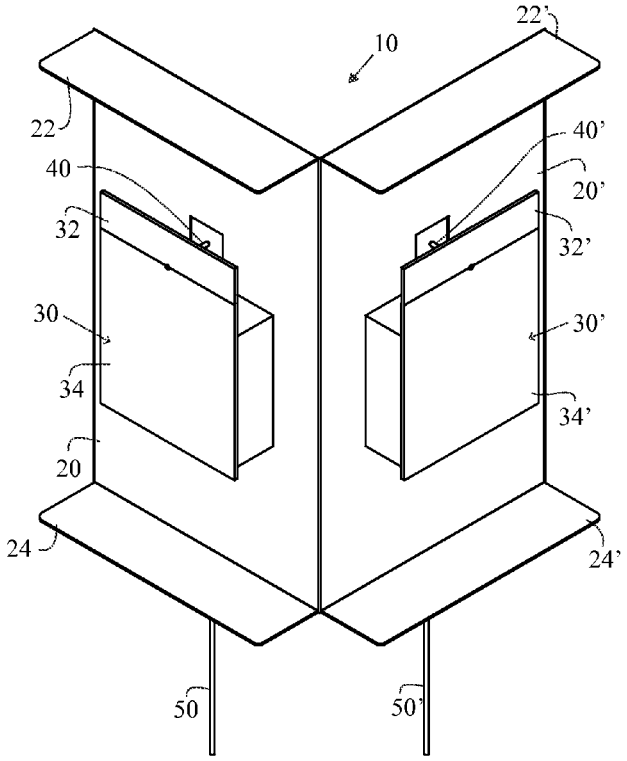
FIG. 16 is a top perspective view of a microstrip patch antenna.

FIGS. 13-16 illustrate an alternative embodiment with two ground plane bases 20 and 20' perpendicular to each other. The first ground plane base 20 has first and second sidewalls 22 and 24. A laminate structure 30 has a substrate layer 32 and a metal top layer 34. An L-shaped feed structure 40 is positioned between the laminate structure 30 and the ground plane base 20. A foam tape spacer 51 is also spaced between in the laminate structure 30 and the ground plane base 20. A cable coax 50 is connected to the L-shaped feed structure 40. The second ground plane base 20' has first and second sidewalls 22' and 24'. A laminate structure 30' has a substrate layer 32' and a metal top layer 34'. An L-shaped feed structure 40' is positioned between the laminate structure 30' and the ground plane base 20'. A foam tape spacer 51' is also spaced between in the laminate structure 30' and the ground plane base 20'. A cable coax 50' is connected to the L-shaped feed structure 40'. A cable interface 60 is shown in FIG. 14.

A distance H3 is preferably approximately 132 mm. A distance H4 is preferably approximately 61 mm. A distance H5 is preferably approximately 37 mm. A distance H6 is preferably approximately 38 mm. A distance H7 is preferably approximately 3 mm. A distance H8 is preferably approximately 14 mm. A distance W5 is preferably approximately 45 mm. A distance W6 is preferably approximately 11 mm. A distance T1 is preferably approximately 0.5 mm.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

We claim as our invention:

1. A patch antenna comprising: a ground plane base; an L-shaped feed structure comprising a pin extending from the ground plane base and a stub substantially perpendicular to the pin; and a laminate structure attached to the stub of the L-shaped feed structure, the laminate structure comprising a substrate layer, a metal layer and a clearance gap, the substrate layer having a bottom surface and a top surface, the metal layer disposed on a portion of the top surface of the substrate layer, the stub attached to the bottom surface of the substrate layer, the clearance gap located around the pin of the L-shaped feed structure in proximity of the metal layer of the laminate structure; wherein the laminate structure has a first end and a second end opposing the first end, and the stub of the L-shaped feed structure extends from the pin towards the first end of the laminate structure, and the metal layer extends from the second end of the laminate structure towards the pin.

2. The patch antenna according to claim 1 wherein the ground plane base further comprises a first sidewall extending upward from a main body and a second sidewall extending upward from the main body, the second sidewall opposite of the first side wall.

3. The patch antenna according to claim 2 wherein the patch antenna operates in the frequency range of 1.7 GHz to 2.2 GHz with a VSWR of 2:1.

4. The patch antenna according to claim 1 wherein the laminate structure is suspended at least 12 mm over the ground plane base.

5. The patch antenna according to claim 1 further comprising a second substrate layer and a second metal layer, the second substrate layer positioned above the top surface of the substrate layer and the metal layer, the second metal layer positioned on a portion of a top layer of the second substrate layer to allow a dual band operation based on a length of the second substrate layer.

6. The patch antenna according to claim 1 wherein the laminate structure has a first end and a second end opposing the first end, and the stub of the L-shaped feed structure extends from the pin towards the first end of the laminate structure, and the metal layer extends from the second end of the laminate structure towards the pin.

7. The patch antenna according to claim 1 wherein the laminate structure has a thickness ranging from 0.5 mm to 1 mm.

8. The patch antenna according to claim 1 wherein the clearance gap has a diameter of approximately 0.5 mm.

9. The patch antenna according to claim 1 wherein the stub member has a length of approximately 10.5 mm and a width of approximately 2 mm.

* * * * *